United States Patent [19]

Schwarz

[11] 4,227,553

[45] Oct. 14, 1980

[54] WEAVING MACHINE WITH HEDDLE FRAMES

[75] Inventor: Rudolf Schwarz, Horgen-Zuerich, Switzerland

[73] Assignee: Staeubli, Ltd., Horgen-Zuerich, Switzerland

[21] Appl. No.: 952,601

[22] Filed: Oct. 18, 1978

[30] Foreign Application Priority Data

Oct. 20, 1977 [CH] Switzerland ..... 12781/77

[51] Int. Cl.[2] ..... D03D 13/00

[52] U.S. Cl. ..... 139/82; 139/91

[58] Field of Search ..... 139/55.1, 82, 91, 92

[56] References Cited

U.S. PATENT DOCUMENTS 3,961,649 6/1976 Palau ..... 139/91

*Primary Examiner*—Henry Jaudon

*Attorney, Agent, or Firm*—Blanchard, Flynn, Thiel, Boutell & Tanis

[57] ABSTRACT

The invention relates to a weaving machine having plural heddle frames, into which heddles are threaded with a free floating characteristic or operational clearance onto thread rails. The heddles are arranged on the thread rails with the least possibility of movement and without a free floating capability during a portion of the heddle frame movement and with a free floating characteristic during the rest of the movement of the heddle frame to facilitate a self-alignment of the heddles with the warp threads. The free floating characteristic is initiated by periodically reducing the distance between the two thread rails.

8 Claims, 9 Drawing Figures

9
3
4
5
90
99B
2
1
99
99A
14
13
130
8
6
12
7
15

2
80
13
128
6
24
120
7

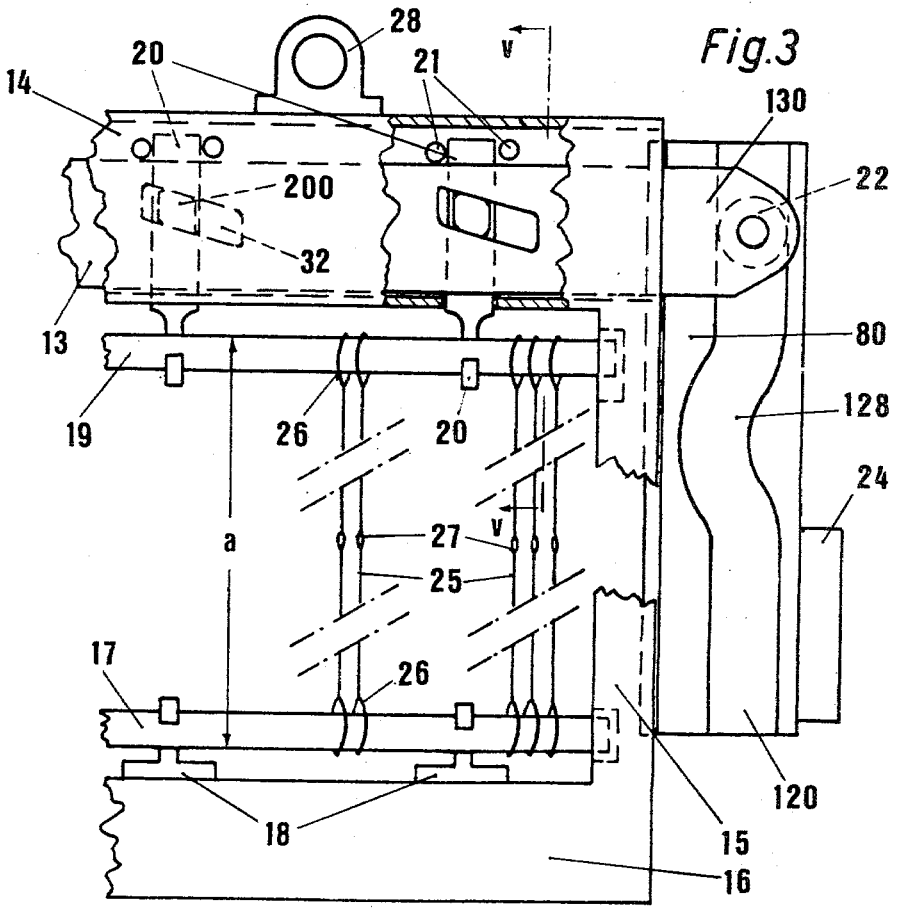
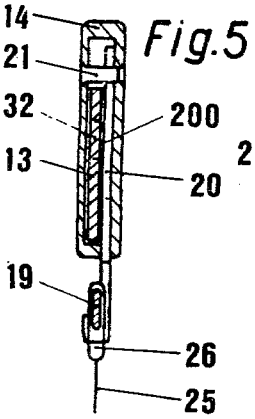
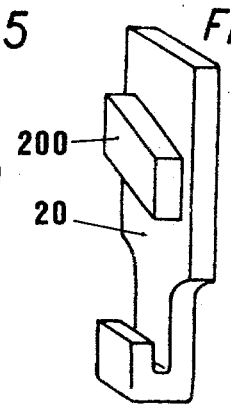
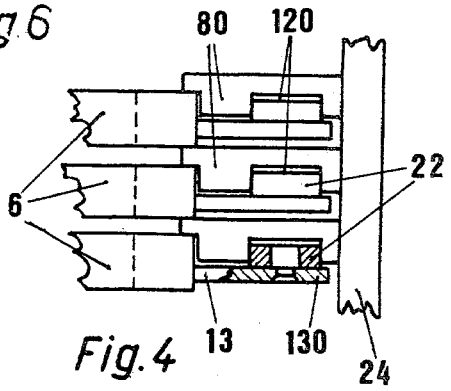
Fig.4

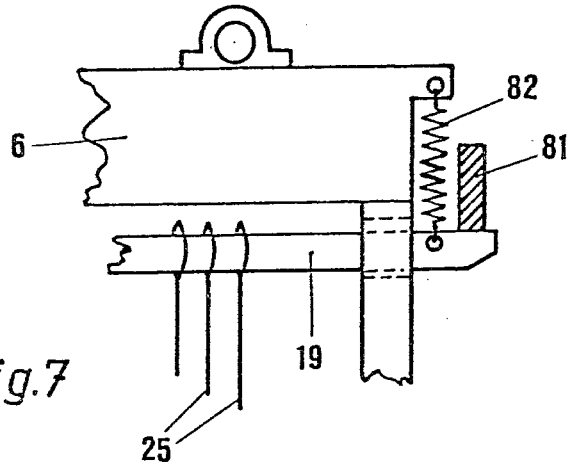
Fig.7
Fig.8
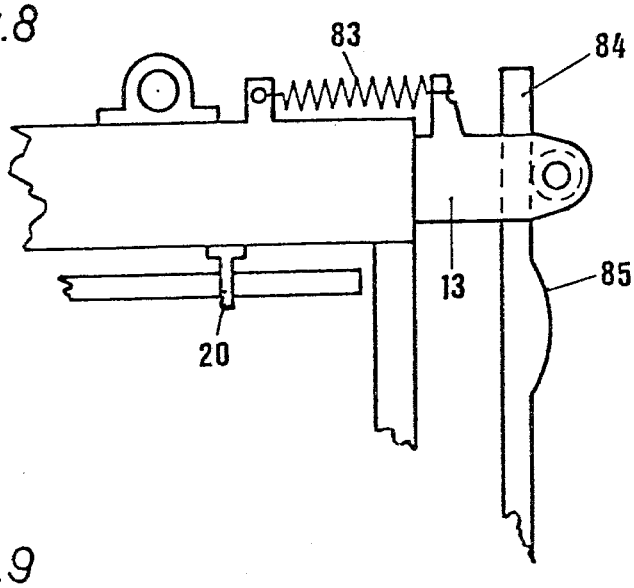
Fig.9
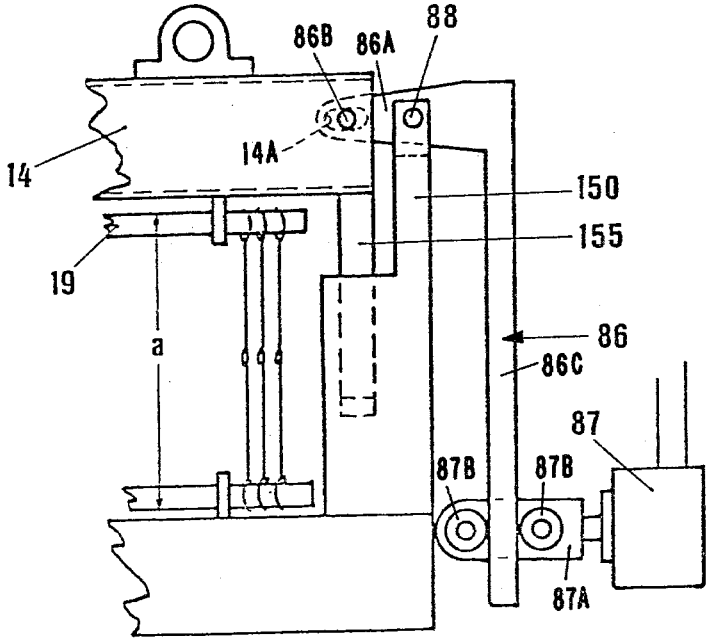

WEAVING MACHINE WITH HEDDLE FRAMES

FIELD OF THE INVENTION

The invention relates to a weaving machine having a heddle frame, the heddles of which are clamped with a free floating characteristic between an upper and a lower thread rail.

BACKGROUND OF THE INVENTION

In the heddle frames of a heddle frame weaving machine, the heddles have eyelets at both ends thereof and each end is threaded onto upper and lower heddle frames or on thread rails which are provided thereat. This type of connection is provided so that the heddles can move in transverse direction with respect to the direction of movement of the heddle frame, however, in the heddle frame plane. It is known to dimension the end eyelet in such a manner that the connection to the thread rails has an all-round clearance, a so-called free floating characteristic.

This free floating characteristic permits the heddles to align themselves in the heddle frame corresponding with the position of the warp threads which they guide. One speaks of a self-alignment characteristic. This free movability between the heddle and the thread rail may lead to a premature wear in particular of the eyelet ends on the heddles. This wear is increased, if due to the movement of the heddle frame unidirected vibrations are present.

The free movability of the heddles has still further disadvantages. In fast-running weaving machines, the heddle frames are accelerated and stopped at forces exceeding lg. In both instances, one eyelet end of the heddle is released a short distance from its endmost position with respect to the thread rail on which it is threaded. The peripheral edge of the other end eyelet engages its associated thread rail. These constant jerking and engaging movements result in worn eyelet ends, tears in the heddle material and gashes or cuts in the thread rails. Furthermore this action creates much noise.

The goal of the present invention is to provide a quieter movement of the heddle frames for the purpose of increasing the production speed, avoiding standstill times which have been caused by damaged material and effect a reduction of the operating noise of the weaving machine.

This goal is achieved with one of the abovementioned weaving machines, which is inventively characterized by means being arranged to periodically change the distance between the two thread rails of one heddle frame.

The free floating feature can therewith be cancelled periodically. A constant cancellation of the free floating feature would result in the disadvantage that the heddles could no longer adjust to the position of the warp threads.

BRIEF DESCRIPTION OF THE DRAWINGS

Exemplary embodiments of the subject matter of the invention are illustrated in the drawings, in which:

FIG. 3 is a partial cross-sectional view of a detail view of the heddle frame according to FIG. 2;

FIG. 4 is a top view of the ends of three adjacent heddle frames according to FIG. 3;

FIG. 5 is a cross-sectional view taken along the line V—V of FIG. 3; and

FIG. 6 is a perspective illustration of a thread rail holder.

FIGS. 7, 8 and 9 are partial cross-sectional views of the heddle frame according to alternative embodiments.

DETAILED DESCRIPTION

Figure 1:
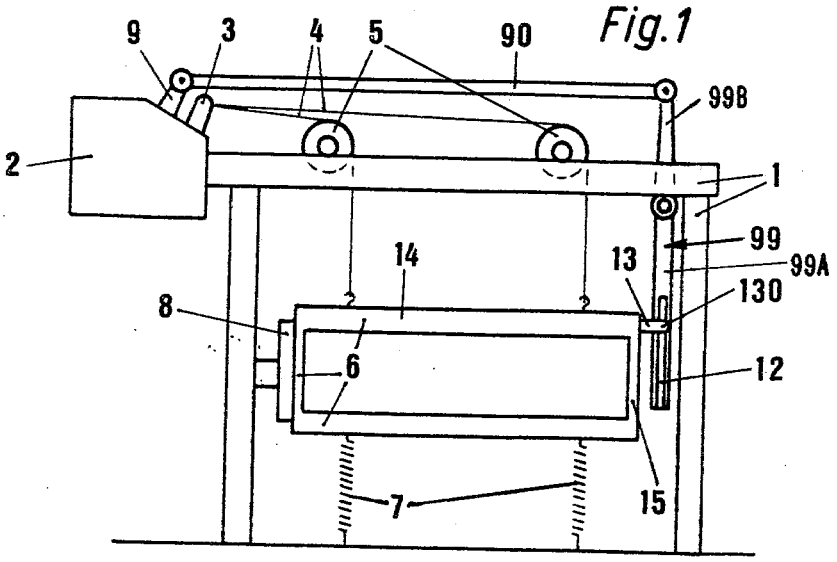
FIG. 1 schematically illustrates a weaving machine with an actively controlled device for reducing the spacing between the thread rails of one heddle frame.

A dobby 2 (or any shed forming mechanism) is mounted on a weaving machine 1 in FIG. 1, which dobby systematically drives a plurality of heddle frames 6 through plural rocker arms 3 and cords 4 which are guided over guide rollers 5. Each heddle frame 6 is biassed by tension springs 7 in a direction counter to the movement generated by the dobby. The heddle frame 6 is enclosed laterally by heddle frame guides 8, the guides on the right side of FIG. 1 are not shown for reasons of providing a clearer view of a rocking lever 99 to be described below.

Parallel with respect to the lateral heddle frame support 15 there is provided an arm 99A of the rocking lever 99, which has an elongated guideway 12 therein into which is received an extension 130 of a rod 13 which is movable in a hollow heddle frame bar 14. The other arm 99B of the rocking lever 99 is connected to a further rocker arm 9 of the dobby through the pull and push lever 90.

Figure 2:
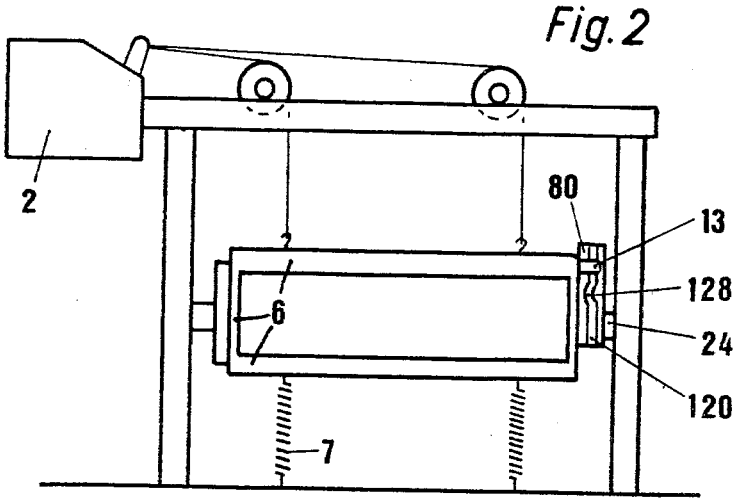
FIG. 2 is a modified embodiment with a passive control.

FIG. 2 principally illustrates the same structure of a weaving machine. The second rocker arm of the dobby and the associated rocking lever 90 (FIG. 1) are missing. The lateral heddle frame guide 80 on the right side of the heddle frame 6 has an elongated guideway 120 therein, into which is received a roller 22 (FIG. 3) on an extended end portion 130 of the rod 13. The guideway 120 has a curved portion 128 located at the point whereat the extended portion of the rod 13 and the heddle frame 6 moves through the crossing of the shed. This partial segment 128 of the guideway causes a temporary transverse movement of the rod 13 relative to the heddle frame when the heddle frame is driven by the dobby 2 or by the springs 7.

The detailed structure of the weaving heddle frame with the heddles which are mounted on thread rails can be recognized from FIGS. 3 to 6.

The lower thread rail 17 is secured through several rail holders 18 on the rigid frame 6, which is formed of a flat and hollow-profile rod 14, side support members 15 and lower heddle-frame rod 16. The upper thread rail 19 is supported in the rail holders 20 and is arranged movably therewith parallel to the plane of the flat and hollow-profile rod 14, and the holders 20 are guided in the hollow profile between spaced bolts 21 fixed to the rod 14. The rod 13 is movably supported for movement along its longitudinal axis in the profile rod 14. The rod 13 has elongated slots or windows 32 therein inclined to the horizontal and spaced from the holders 20, which slots each slidingly receive a sliding member 200 secured to the holder 20. The extension 130 of the rod 13 projects from the hollow-profile rod 14, has the roller 22 thereon rotatably supported on a bolt and is received in the slot 120 of the heddle-frame guide 80. The heddle-frame guide is fixedly connected to the frame of the weaving machine through the mounting member 24. The ends 26 of the heddles 25 have loops thereat which are threaded onto the thread rails 17, 19. The loops or end eyelets are larger in diameter than the peripheral dimension of the thread rails. The heddles 25 each have a thread eye 27 in the center thereof. The position illustrated is the maximum possible distance a between the thread rails 17, 19, which causes the heddles to have little to no clearance in their longitudinal length. In other words, the heddles are rendered taut between the thread rails 17 and 19.

The driving element 4 which is connected to the rocking lever 3 of the dobby is connected to a bracket 28 on the hollow-profile rod 14. If the heddle frame 6 is lowered, for example, under the effect of the return force of the springs 7, the roller 22 moves in a half of the segment of the curved portion 128 of the slot 120, which causes the rod 13 to be moved temporarily leftwardly. Due to the inclination of the slots 32, the sliding members 200 and thus the holders 20 and the rail 19 move downwardly, which results in a reduction in size of the distance a. This causes the heddles 25 to achieve a free floating characteristic, which permits a self-alignment at all times according to the position of the warp thread.

The effect of the lateral movement of the rod 13 and therewith the lowering of the rail 19 is obtained in the modified embodiment according to FIG. 1 by a pivoting of the lever 99. Here the extended portion 130 of the rod 13 also is received in the slot 12. Since the swinging movement of the lever can be released at any desired time by the dobby 2, the free floating characteristic can be created, for example, also in the extreme positions of the heddle frames, namely in the upper or lower shed position.

The control of the holders 20, aside from the described mechanical type, can also be done in an electrical, hydraulic or pneumatic manner. Furthermore, the rocking lever 99 can be driven by the weaving machine itself or an independent aggregate. Also the possibility as shown in FIGS. 7 and 9, exists to lend the heddle frame in one of its two end positions during the shed standstill time a small overlift in order to temporarily form and cancel the free floating characteristic with this additional movement, before the heddle frame is again accelerated.

This can be done for example, according to FIG. 7, by at least one rail 19 laterally projecting beyond the heddle frame 6 and engaging against the power of a spring 82, toward a fixed part 81 of the machine frame during a movement of the heddle frame. Thus, when the heddle frame moves beyond the normal limits of movement, the rail 19 will engage the fixed part 81 to effect the movement of the rail 19 against the urging of the spring 82.

According to FIG. 8 and as a variant to the examples as shown in FIGS. 1 to 6, the rod 13 or the holder 20 can also be under the influence of tensioned springs 83, which acts in accordance with cancellation of the free floating characteristic, while the lever 84 or the slot cam surface 85 resists this spring force to temporarily produce the clearance.

As shown in FIG. 9 it is also conceivable to move the rail 19 with the heddle frame rod 14 in relationship to the distance a, whereby for example the side supports 150 and 155 of the heddle frame are exposed to a change in length, for example by telescoping or bending. This could be accomplished by providing an L-shaped lever arm 86 pivotally secured to the lower heddle frame part at a pivot axle 88. One leg 86A has a pin 86B thereon received in an elongated slot 14A in the upper part of the heddle frame or the frame rod 14. The other leg 86C of the lever 86 extends to a power drive device 87, the armature 87A is slidably connected to the leg 86C by the leg being received between a pair of rollers 87B. The solenoid 87 is secured to the weaving machine frame 1 and is actuated in response to a movement of the heddle frame.

In all exemplary embodiments, the distance between both thread rails is periodically changed, and for example during the passage of the heddle frame through the crossing of the shed, the distance between the rails is made the smallest and prior to the end of the heddle frame lift movement is made the greatest. In the latter case, the clearance of the heddles with respect to the thread rails is cancelled or is reduced but for a small amount. The distance change between both thread rails occurs thereby passively, namely from a self-initiated movement of the heddle frame, or actively controlled by a separate drive. In the latter case, it is possible for the alternating play in the production and cancellation of the free floating characteristic to take place weft for weft or with interruptions of one or several wefts and primarily collectively for the entire weft package in one weaving machine, regardless of whether all heddle frames or only one part thereof is in the moving phase. However, it is also possible with the help of the active control to reduce and to increase again the distance between the two thread rails only during a shed standstill so that during the entire time of movement of the heddle frame the heddles have no clearance in the thread rails.

As a result of this arrangement, the heddles are positioned preferably at the start and end of a heddle frame lift clearance-free or at least a minimum tolerance on the thread rails and are thus capable to overcome without any damage the great accelerating forces which exist during these periods, while in the area of the crossing of the shed or of the shed standstill the usual free floating characteristic to facilitate a self-alignment of the heddle exists during the period of small forces. Also the vibrations in the heddle frame which are superposed over a heddle-frame lift have themselves only a small damaging effect on the heddles, since they have little to no clearance at all.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A weaving machine having a shed forming means thereon comprising:

frame means;

a heddle frame movably supported on said frame means;

first and second spaced and parallel thread rail means mounted on said heddle frame;

at least one heddle connected to and extending between said first and second thread rail means;

first means for effecting a change in the spacing between said first and second thread rail means in response to a movement of said heddle frame, said first means including control means, separate from said shed forming means, secured to said frame means for controlling the relative spacing between said first and second thread rail means; and connecting means for operatively connecting said control means to one of said first and second thread rail means for causing said one of said first and second thread rail means to move selectively at least one of toward and away from the other of said first and second thread rail means in response to said movement of said heddle frame.

2. The weaving machine having a shed forming means thereon according to claim 1, wherein said control means comprises:

(a) thread rail holder means supporting said one of said first and second thread rail means and being reciprocally mounted on said heddle frame for movement in a direction toward and away from said other of said first and second thread rail means and having a cam follower means thereon; and (b) a rod reciprocally mounted on said heddle frame and movable in a direction parallel to the longitudinal axis of said first and second thread rail means and having inclined cam surface means thereon on which is engaged said cam follower means, said cam follower means effecting said movement of said thread rail holder means toward and away from the other of said thread rail means in response to a reciprocation of said rod in a direction parallel to the longitudinal axis of said first and second thread rail means.

3. The weaving machine having a shed forming means thereon according to claim 2, wherein said control means further includes an elongated and stationary guideway secured to said frame means and extending parallel to the direction of movement of said heddle frame; and wherein said rod has an extension means thereon received in said guideway, said guideway having a lateral curved segment approximately in the center of the path of movement of said extension means in said guideway.

4. The weaving machine having a shed forming means thereon according to claim 2, wherein said control means comprises:

a first rocker arm pivotally secured to said frame means and having an elongated guideway thereon;

wherein said rod has an extension means received in said guideway;

wherein said first rocker arm is operatively connected to a second rocker arm on said shed forming means to effect a rocking of said first rocker arm and said movement of said one of said first and second thread rail means at least one of toward and away from each other.

5. The weaving machine having a shed forming means thereon according to claim 2, wherein said control means further includes resilient means for normally urging said first and second thread rail means away from each other to hold said heddle taut; and wherein said cam follower means engaging said cam surface means effects a movement of said one of said first and second thread rail means toward the other of said first and second thread rail means in response to a reciprocation of said rod in a direction parallel to the longitudinal axis of said first and second thread rail means.

6. The weaving machine having a shed forming means thereon according to claim 1, wherein said heddle frame is comprised of two parts;

wherein said control means includes power drive means operatively connected to said one of said first and second thread rail means; and wherein said one of said first and second thread rail means is said first part of said heddle frame and is supported for relative movement with respect to said second part of said heddle frame.

7. The weaving machine having a shed forming means thereon according to claim 6, wherein said first and second parts of said heddle frame are both U-shaped having parallel legs thereon;

wherein the legs of said U on one of said first and second parts of said heddle frame are received in guides on the other of said first and second parts of said heddle frame to facilitate a guiding of said one of said first parts relative to the other of said first and second parts of said heddle frame.

8. The weaving machine having a shed forming means thereon according to claim 1, wherein said control means includes resilient means for normally urging said first and second thread rail means away from each other to hold said heddle taut; and wherein said control means includes a fixed part on said frame means for engaging said one of said first and second thread rail means during said movement of said heddle frame to limit any further movement thereof with said one of said first and second thread rail means to thereby effect a loosening of said heddle between said first and second thread rail means.

* * * * *